US006527362B2

(12) United States Patent
Hood et al.

(10) Patent No.: US 6,527,362 B2
(45) **Date of Patent: *Mar. 4, 2003**

(54) GROOVED TIP WIPER FOR CLEANING INKJET PRINTHEADS

(75) Inventors: Dawn M. Beachnau Hood, Portland, OR (US); Todd M. Gaasch, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 72 days.

This patent is subject to a terminal disclaimer.

(21) Appl. No.: 09/832,542

(22) Filed: Apr. 11, 2001

(65) Prior Publication Data

US 2001/0043251 A1 Nov. 22, 2001

Related U.S. Application Data

(63) Continuation of application No. 09/383,705, filed on Aug. 26, 1999, now abandoned.

(51) Int. Cl.[7] ..... B41J 2/165
(52) U.S. Cl. ..... 347/33
(58) Field of Search ..... 347/33, 29, 32, 347/22; 15/250.361; 101/155, 167

(56) References Cited

U.S. PATENT DOCUMENTS

| | | | | |
|---|---|---|---|---|
| 5,151,715 A | | 9/1992 | Ward et al. | 347/33 |
| 5,300,958 A | | 4/1994 | Burke et al. | 347/28 |
| 5,489,927 A | | 2/1996 | Harmon | 347/33 |
| 5,500,660 A | | 3/1996 | Childers et al. | 347/33 |
| 5,583,548 A | | 12/1996 | Kearns | 347/33 |
| 5,602,573 A | | 2/1997 | Waschhauser et al. | 347/33 |
| 5,745,133 A | | 4/1998 | Hendricks et al. | 347/33 |
| 5,815,176 A | * | 9/1998 | Rotering et al. | 347/33 |
| 5,997,128 A | * | 12/1999 | Lou et al. | 347/33 |
| 6,102,518 A | * | 8/2000 | Taylor | 347/29 |
| 6,155,666 A | * | 12/2000 | Sugimoto et al. | 347/24 |

FOREIGN PATENT DOCUMENTS

| | | |
|---|---|---|
| EP | 362113553 | 5/1987 |
| EP | 0446885 | 9/1991 |
| EP | 0558219 | 9/1993 |
| EP | 0856404 | 8/1998 |

OTHER PUBLICATIONS

European Patent Office Search Report dated Mar. 13, 2001., De Grout, R, EP 00306608.

* cited by examiner

*Primary Examiner*—Shih-Wen Hsieh

(57) ABSTRACT

An inkjet printhead service station for cleaning an inkjet printing mechanism includes a printhead wiping system having a grooved wiper blade tip for wiping ink residue from the printhead, which is especially useful for cleaning printheads having surface irregularities such as encapsulant beads, which are required to assemble the printhead. The wiper blade is supported by a sled to engage and wipe the printhead in a wiping direction, with the blade having a wiping tip which defines a transverse groove running transverse to the wiping direction. The wiper blade has opposing leading and trailing surfaces between which the groove runs, preferably without intersecting either the leading surface or the trailing surface. An inkjet printing mechanism having such a wiping system, and a method of cleaning an inkjet printhead are also provided.

40 Claims, 5 Drawing Sheets

GROOVED TIP WIPER FOR CLEANING INKJET PRINTHEADS

CROSS REFERENCE TO RELATED APPLICATIONS

This is a continuation of application Ser. No. 09/383,705 filed on Aug. 26, 1999 now abandoned.

FIELD OF THE INVENTION

The present invention relates generally to inkjet printing mechanisms, and more particularly to a grooved wiper blade tip for wiping ink residue from inkjet printheads, and especially for cleaning printheads having surface irregularities such as encapsulant beads, which are required to assemble the printhead.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. To facilitate priming, some printers have priming caps that are connected to a pumping unit to draw a vacuum on the printhead. During operation, partial occlusions or clogs in the printhead are periodically cleared by firing a number of drops of ink through each of the nozzles in a clearing or purging process known as "spitting." The waste ink is collected at a spitting reservoir portion of the service station, known as a "spittoon." After spitting, uncapping, or occasionally during printing, most service stations have a flexible wiper, or a more rigid spring-loaded wiper, that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solids content than the earlier dye-based inks, which results in a higher optical density for the new inks. Both types of ink dry quickly, which allows inkjet printing mechanisms to use plain paper. Unfortunately, the combination of small nozzles and quick-drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, keeping the nozzle face plate clean becomes even more important when using pigment based inks, because they tend to accumulate more debris than the earlier dye based inks.

Indeed, keeping the nozzle face plate clean for cartridges using pigment based inks has proven quite challenging. These pigment based inks require a higher wiping force than that previously needed for dye based inks. Yet, there is an upper limit to the wiping force because excessive forces may damage the orifice plate. Thus, a delicate balance is required in wiper design to adequately clean the orifice plate to maintain print quality, while avoiding damage to the nozzle plate itself.

Many previous wiping solutions used a cantilever wiping approach. In cantilever wiping, a flexible, low durometer elastomeric blade is supported at its base by a sled. While the sled may be stationary, in many designs it was moveable so the sled could travel to a position where the wipers engage the nozzle plate. Wiping was accomplished through relative motion of the wipers with respect to the nozzle plate, by either moving the wiper relative to a stationary nozzle plate, or by moving the nozzle plate relative to a stationary wiper. The earlier wiper positioning mechanisms included sled and ramp systems, rack and pinion gear systems, and rotary systems.

The flexibility of the cantilever wiper accommodates for variations in the distance between the nozzle plate and sled, also referred to as variations in the "interference" between the wiper and nozzle plate. That is, for a closer sled-to-nozzle spacing (or a "greater interference"), the wiper flexed more than it would for a larger spacing. The force transmitted to the face plate was determined by the degree of bending of the wiper blade, as well as by the stiffness of the wiper blade material. The stiffness of the wiper blade is a function of the geometry of the blade and of the material selected. For instance, one common measure of elastomeric flexibility (tested using a sample of a standard size) is known as the "durometer," including a variety of scales known to those skilled in the art, such as the Shore A durometer scale.

Besides focusing on the material selection for inkjet wipers, other research has investigated changing the contour of the wiper tip which contacts the printhead orifice plate. A revolutionary rotary, orthogonal wiping scheme was first used in the Hewlett-Packard Company's DeskJet® 850C color inkjet printer, where the wipers ran along the length of the linear arrays, wicking ink from one nozzle to the next. This wicked ink acted as a solvent to break down ink residue accumulated on the nozzle plate. This product used a dual wiper blade system as shown in FIGS. 7 and 8, where wiper blades W1 and W2 project from a supporting sled S. The wiper blades W1 and W2 have special contours at their tips to facilitate this wicking action and subsequent printhead cleaning. Each blade W1 and W2 has an outboard rounded edge R and an inboard angular wiping edge A. The rounded edges R encounter the nozzles first and form a capillary channel between the blade and the orifice plate to wick ink from the nozzles as the wipers moved orthogonally along the length of the nozzle arrays. The wicked ink is pulled by the rounded edge R of the leading wiper blade to the next nozzle in the array, where it acts as a solvent to dissolve dried ink residue accumulated on the printhead face plate. The angular edge A of the trailing wiper blade then scraps the dissolved residue from the orifice plate. The black ink wiper has notches cut in the tip which served as escape passageways for balled-up ink residue to be moved away from the nozzle arrays during the wiping stroke.

Another wiping system using a spring-loaded, non-bending upright wiper was first sold in the Hewlett-Packard Company's DeskJet® 660C color inkjet printer. Through a rocking action of the wiper blade and compression of the spring, manufacturing tolerance variations were accommodate for, including component variations in the service station, the Printhead carriage, and in the pens themselves.

Thus, there have been two major categories of wiper designs used in service stations in the past, namely (1) the flexible cantilever blade wipers, and (2) the spring-loaded, non-bending wipers. The cantilevered wipers relied on the compliance of the wiper material to provide enough normal force (the force perpendicular to the orifice plate) and enough frictional force to wipe ink residue and other debris from the orifice plate. The spring-loaded wipers used a shorter more rigid wiper, with the force applied to the orifice plate being controlled by selection of the spring. Both the cantilevered wiper and the spring-loaded wipers had difficulty cleaning across the raised encapsulant bead at each end of the orifice plate.

As illustrated in FIG. 8, inkjet printheads are constructed using a pair of encapsulant beads, such as bead E, which run along opposing edges of the silicon orifice plate P to cover the connections between the printhead resistors and an electrical flex circuit. The flex circuit delivers the nozzle firing signals from the carriage electrical interface to the printhead resistors. An energized resistor heats the ink until a droplet is ejected from a nozzle N associated with the energized resistor. The encapsulant beads E are typically constructed from an encapsulant material, such as an epoxy or plastic material. Unfortunately, the encapsulant beads E project beyond the outer surface of the orifice plate.

Due to the shape and location of the encapsulant beads, at the beginning of a wiping stroke the rounded leading edge of the cantilevered wiper blade initially contacts the orifice plate near the encapsulant bead, as shown in FIG. 8. As the wiper W2 traverses to the right in FIG. 8, there is a decrease in the normal force (the force perpendicular to the orifice plate) as the blade slides over the edge of the encapsulant bead E closest to the nozzles N. This decrease in the normal force as the blade leaves the encapsulant bead E may sometimes result in less effective wiping of the nozzles closest to the encapsulant bead. While this touchdown area T is relatively short, as new Printhead designs move the nozzles in closer to the encapsulant beads, a new wiping solution is needed to ensure that nozzles in the touchdown zone T are adequately wiped.

SUMMARY OF THE INVENTION

According to one aspect of the present invention, a wiping system is provided for cleaning an inkjet printhead of an inkjet printing mechanism having a chassis. The wiping system includes a sled supported by the chassis, and a wiper blade supported by the sled to engage and wipe the printhead through relative motion of the blade and the printhead in a wiping direction. The wiper blade has a wiping tip which defines a transverse groove running transverse to the wiping direction.

According to another aspect of the present invention, a wiping system is provided for cleaning an inkjet printhead of an inkjet printing mechanism having a chassis. The wiping system includes a sled supported by the chassis, and a wiper blade supported by the sled to engage and wipe the printhead through relative motion of the blade and the printhead in a wiping direction. The wiper blade has a leading surface, which encounters the printhead when wiping in the wiping direction, and a trailing surface opposing the leading surface. The leading surface and the trailing surface are joined at a wiping tip which defines a groove therein running between the leading surface and the trailing surface.

According to a further aspect of the present invention, an inkjet printing mechanism is provided including a wiping system, which may be as described above.

According to an additional aspect of the present invention, a method of cleaning an inkjet printhead of an inkjet printing mechanism is provided. The method includes the steps of providing a wiper blade having a first surface, and a second surface opposing the first surface, with the first surface and the second surface joining at a wiping tip which defines a groove therein running between the first surface and the second surface without intersecting at least one of the first and second surfaces. In a wiping step, the printhead is wiped with the wiper blade through relative motion of the wiper blade and the printhead. The method further includes the step of, during the wiping step, at least partially closing the groove.

An overall goal of the present invention is to provide a printhead service station for an inkjet printing mechanism that facilitates printing of sharp vivid images, particularly when using fast drying pigment based, co-precipitating, or dye based inks by providing fast and efficient printhead servicing.

A further goal of the present invention is to provide a method of servicing an inkjet printhead that is expediently accomplished in an efficient manner.

DETAILED DESCRIPTION OF THE PREFERRED EMBODIMENTS

Figure 1:
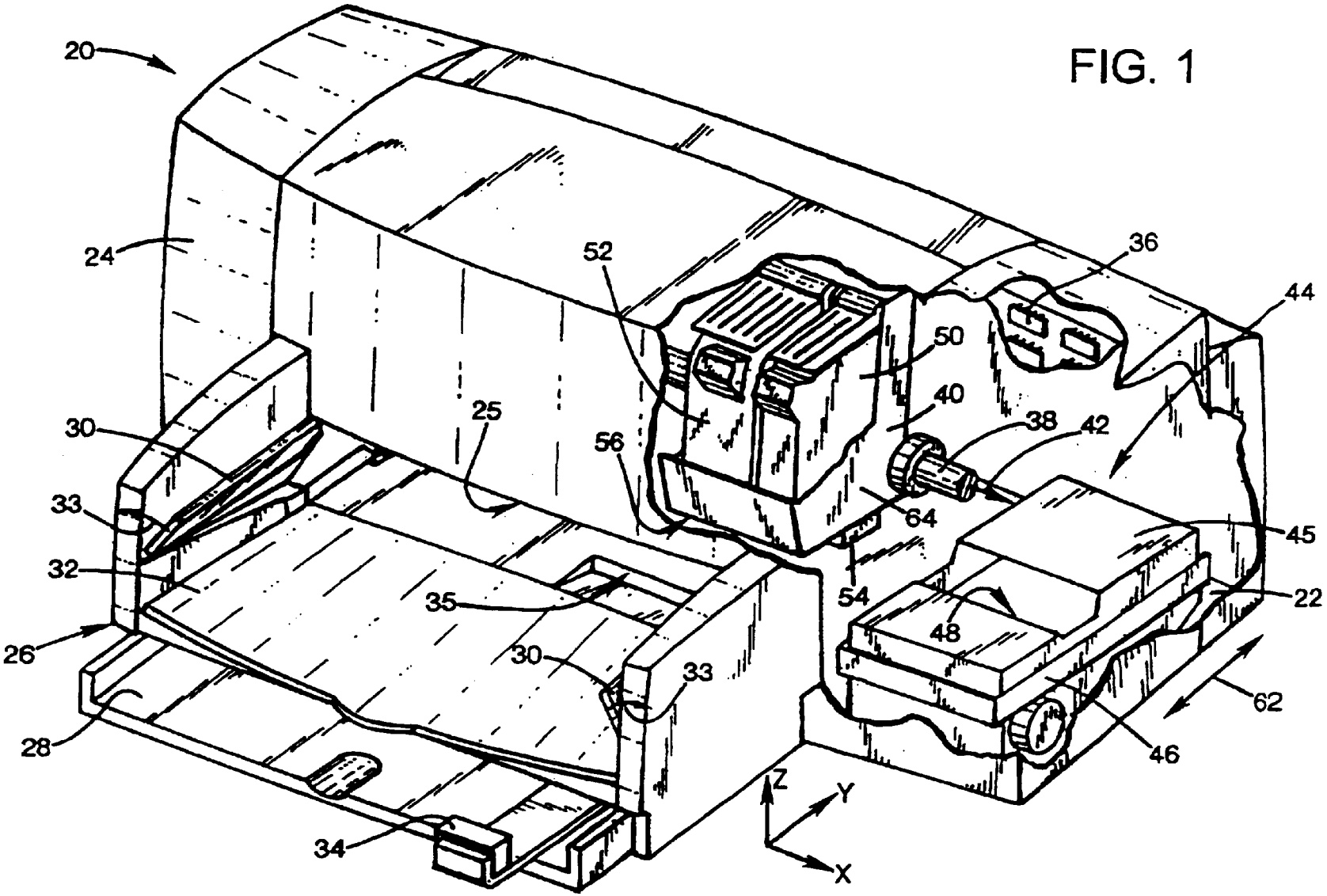
FIG. 1 is a fragmented, partially schematic, perspective view of one form of an inkjet printing mechanism including a servicing station of the present invention which has a pair of wiper blades with grooved wiping tips.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a printzone 25 by an adaptive print media handling system 26, constructed in accordance with the present invention. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional motor-driven paper drive rollers (not shown) may be used to move the print media from tray 28 into the printzone 25 for printing. After printing, the sheet then lands on a pair of retractable output drying wing members 30, shown extended to receive a printed sheet. The wings 30 momentarily hold the newly printed sheet above any previously printed sheets still drying in an output tray portion 32 before pivotally retracting to the sides, as shown by curved arrows 33, to drop the newly printed sheet into the output tray 32. The media handling system 26 may include a series of adjustment mechanisms for accommodating different sizes of print media, including letter, legal, A-4, envelopes, etc., such as a sliding length adjustment lever 34, and an envelope feed slot 35.

The printer 20 also has a printer controller, illustrated schematically as a microprocessor 36, that receives instructions from a host device, typically a computer, such as a personal computer (not shown). Indeed, many of the printer controller functions may be performed by the host computer, by the electronics on board the printer, or by interactions therebetween. As used herein, the term "printer controller 36" encompasses these functions, whether performed by the host computer, the printer, an intermediary device therebetween, or by a combined interaction of such elements. The printer controller 36 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 38 is mounted to the chassis 22 to slideably support a reciprocating inkjet carriage 40, which travels back and forth across the printzone 25 along a scanning axis 42 defined by the guide rod 38. One suitable type of carriage support system is shown in U.S. Pat. No. 5,366,305, assigned to Hewlett-Packard Company, the assignee of the present invention. A conventional carriage propulsion system may be used to drive carriage 40, including a position feedback system, which communicates carriage position signals to the controller 36. For instance, a carriage drive gear and DC motor assembly may be coupled to drive an endless belt secured in a conventional manner to the pen carriage 40, with the motor operating in response to control signals received from the printer controller 36. To provide carriage positional feedback information to printer controller 36, an optical encoder reader may be mounted to carriage 40 to read an encoder strip extending along the path of carriage travel.

The carriage 40 is also propelled along guide rod 38 into a servicing region, as indicated generally by arrow 44, located within the interior of the casing 24. The servicing region 44 houses a service station 45, which may provide various conventional printhead servicing functions. For example, a service station frame 46 holds a group of printhead servicing appliances, described in greater detail below. In FIG. 1, a spittoon portion 48 of the service station is shown as being defined, at least in part, by the service station frame 46.

In the printzone 25, the media sheet receives ink from an inkjet cartridge, such as a black ink cartridge 50 and/or a color ink cartridge 52. The cartridges 50 and 52 are also often called "pens" by those in the art. The illustrated color pen 52 is a tri-color pen, although in some embodiments, a set of discrete monochrome pens may be used. While the color pen 52 may contain a pigment based ink, for the purposes of illustration, pen 52 is described as containing three dye based ink colors, such as cyan, yellow and magenta. The black ink pen 50 is illustrated herein as containing a pigment based ink. It is apparent that other types of inks may also be used in pens 50, 52, such as thermoplastic, wax or paraffin based inks, as well as hybrid or composite inks having both dye and pigment characteristics.

The illustrated pens 50, 52 each include reservoirs for storing a supply of ink. The pens 50, 52 have printheads 54, 56 respectively, each of which have an orifice plate with a plurality of nozzles formed therethrough in a manner well known to those skilled in the art. The illustrated printheads 54, 56 are thermal inkjet printheads, although other types of printheads may be used, such as piezoelectric printheads. Indeed, the printheads 54 and 56 may be constructed as illustrated by printhead P in the prior art drawing of FIG. 8, including nozzles N and a pair of encapsulant beads E, as described in the Background Section above; however, it is apparent that other printheads may be constructed without encapsulant beads. These printheads 54, 56 typically include a substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a conventional multi-conductor strip (not shown) from the controller 36 to the printhead carriage 40, and through conventional interconnects between the carriage and pens 50, 52 to the printheads 54, 56.

Preferably, the outer surface of the orifice plates of printheads 54, 56 lie in a common printhead plane. This printhead plane may be used as a reference plane for establishing a desired media-to-printhead spacing, which is one important component of print quality. Furthermore, this printhead plane may also serve as a servicing reference plane, to which the various appliances of the service station 45 may be adjusted for optimum pen servicing. Proper pen servicing not only enhances print quality, but also prolongs pen life by maintaining the health of the printheads 54 and 56.

To provide higher resolution hardcopy printed images, recent advances in printhead technology have focused on increasing the nozzle density, with levels now being on the order of 300 nozzles per printhead, aligned in two 150-nozzle linear arrays for the black pen 50, and 432 nozzles for the color pen 52, arranged in six 72-nozzle arrays with two arrays for each color. These increases in nozzle density, present limitations in printhead silicon size, pen-to-paper spacing considerations, and media handling requirements have all constrained the amount of room on the orifice plate. While the printhead and flex circuit may be conventional in nature, the increased nozzle density requires optimization of wiping performance, including wiping over uneven surface irregularities. For example, the printhead nozzle surface is bounded on each end by two end beads of an encapsulant material, such as bead E of an epoxy or plastic material, which covers the connection between a conventional flex circuit and the printhead housing the ink firing chambers and nozzles. Other printhead constructions may not require encapsulant beads, but instead may have other surface irregularities which may cause wiping difficulties when using the earlier cantilevered wipers or the spring-loaded wipers described in the Background Section above.

Figure 2:
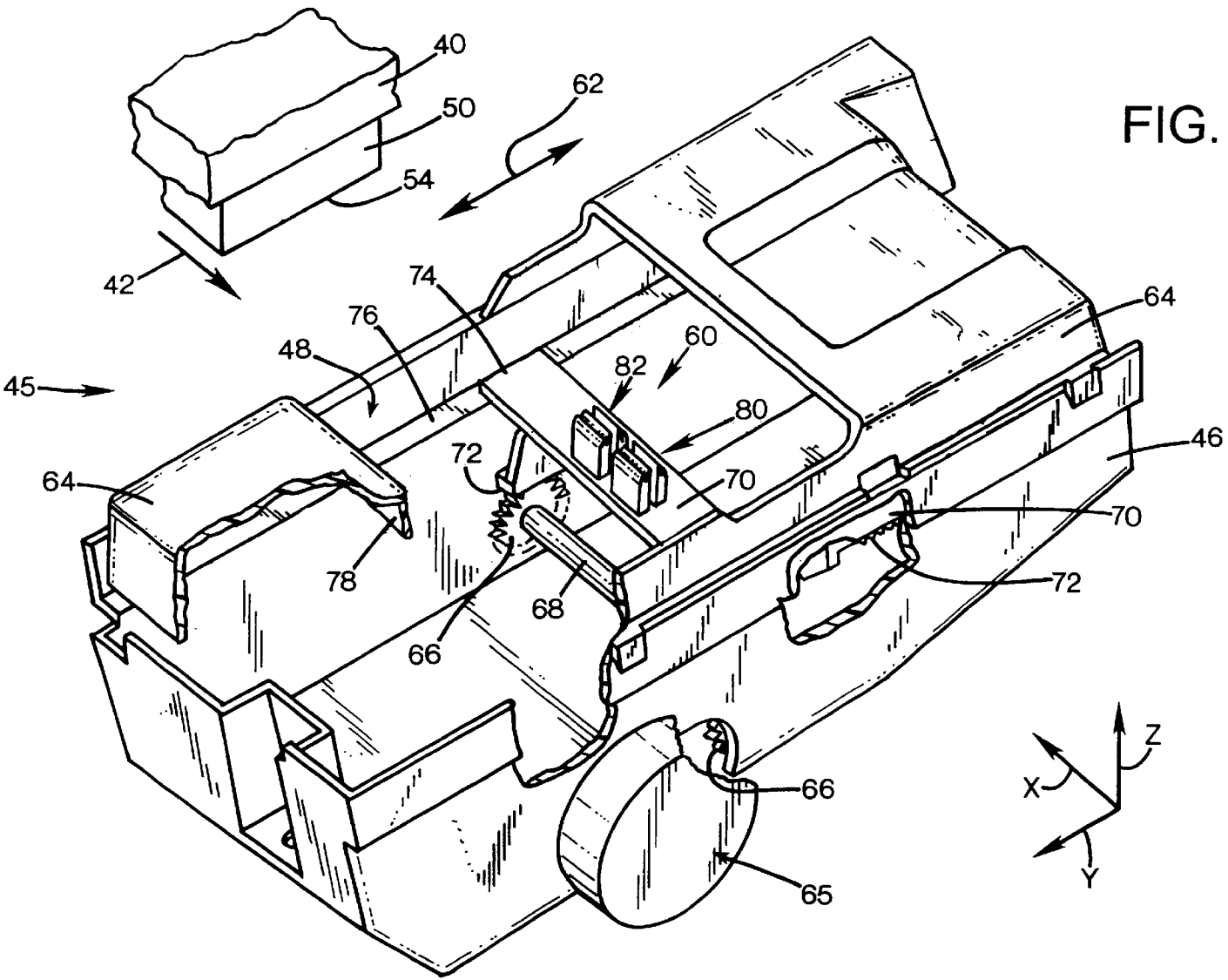
FIG. 2 is a fragmented, perspective view of one form of a service station of FIG. 1.

FIG. 2 shows one embodiment of a grooved tip wiper blade printhead cleaning system 60, constructed in accordance with the present invention and installed in the translational service station 45. The service station 45 facilitates orthogonal printhead wiping strokes, that is, wiping along the length of the linear nozzle arrays of the printheads 54 and 56, as indicated by arrow 62, which is perpendicular to the scan axis 42. The service station 45 includes an upper frame portion or bonnet 64 which is attached to the frame base 46. The exterior of the frame base 46 supports a conventional service station drive motor and gear assembly 65, which may include a stepper motor or a DC (direct current) motor, that is coupled to drive one of a pair of drive gears 66 of a spindle pinion drive gear assembly 68. The spindle gear 68 drives a translationally movable wiper support platform, pallet or sled 70 in the directions indicated by arrow 62 for printhead servicing. The pallet 62 may carry other servicing components, such as a pair of conventional caps (not shown) for sealing the printheads during periods of inactivity. The pair of spindle gears 66 each engage respective gears of a pair of rack gears 72 formed along a lower surface of pallet 70. The pallet 70 has sliding supports 74 that ride in tracks 76 defined along the interior surfaces of the frame base 46 and/or bonnet 64 for translational movement toward the front and rear of the printer 20, as indicated by arrow 62. A wiper scraper bar 78 extends downwardly from the bonnet 64.

Figure 3:
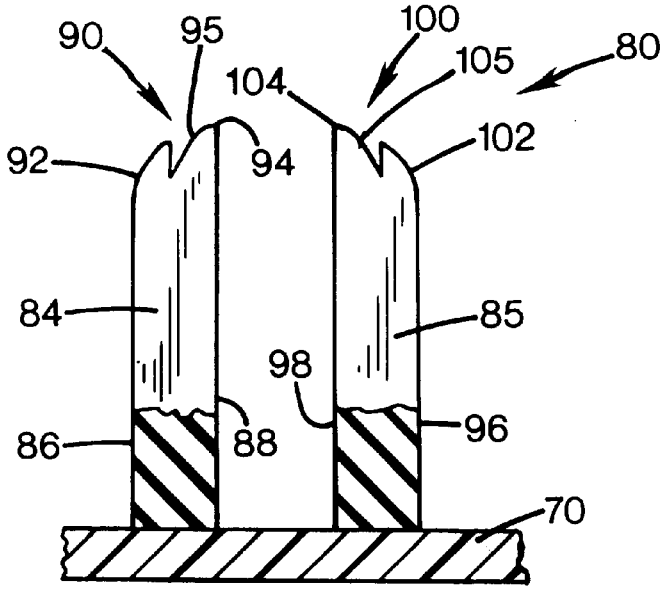
FIG. 3 is an enlarged, partially fragmented, side elevational view of one form of a pair inkjet printhead wipers of the service station of FIG. 1.

The grooved tip wiping system 60 includes a black ink wiping assembly 80 for wiping the black printhead 54, and a color wiping assembly 82 for wiping the tricolor printhead 56. In the illustrated embodiment, both the black and color wiping assemblies 80, 82 are constructed identically, although it is apparent to those skilled art that in some implementations it may be preferable to provide the black wiping assembly 80 with ink residue escape recesses, such as taught in U.S. Pat. No. 5,614,930, assigned to the Hewlett-Packard Company. FIG. 3 illustrates the black wiper assembly 80 in greater detail. Here we see the black wiper assembly 80 has a pair of wiper blades 84 and 85, which project upwardly from the service station pallet or sled 70. Preferably, the wiper blades 84, 85 are constructed from a flexible material, which may be constructed from any conventional material known to those skilled in the art, but preferably, they are of a resilient, non-abrasive, elastomeric material, such as nitrile rubber, or more preferably, ethylene polypropylene diene monomer (EPDM). The wiper blades 84, 85 may be attached to the pallet 70 in a variety of manners known to those skilled in the art, such as by bonding, by onsert molding, or by onsert molding the blades to a separate wiper mounting member, such as a stainless steel clip which is then snapped into place on the pallet 70.

The wiper blade 84 has a an exterior surface 86 and an interior surface 88, which faces the other wiper blade 85. The blade 84 terminates in a grooved wiping tip 90, which in profile has an arcuate or rounded wiping edge 92 along the outboard surface 86, and an angular or square wiping edge 94 along the interior surface 88. Between the rounded wiping edge 92 and the angular wiping edge 94, the wiper tip 90 defines a groove 95, which runs along the width of the wiper blade 84 and serves to separate the rounded edge 92 from the angular wiping edge 94. This groove 95 also looks like a mouth when viewed in cross-section, as shown in FIG. 3. The other wiper blade 85 has an exterior surface 96 and an interior surface 98 which faces wiper blade 84. The wiper blade 85 terminates in a grooved wiping tip 100, which is basically a mirror image of wiper tip 90, having in profile an arcuate or rounded exterior wiping edge 102, and an angular or square interior wiping edge 104. Between the wiping edges 102 and 104 the wiper blade 85 defines a groove or recess 105, which also looks like a mouth in the cross-sectional view of FIG. 3.

By constructing the wiper assemblies 80, 82 as symmetrical pairs of wiper blades, as illustrated by blades 84 and 84, bidirectional wiping strokes may be used to scrub and clean and printheads 54, 56, with the leading blade first contacting the orifice plate and the trailing blade following the leading blade. Thus, when wiping in one direction blade 84 is the leading blade and blade 85 is the trailing blade, while when wiping in the opposite direction, blade 85 is the leading blade and blade 84 is the trailing blade.

Figure 4:
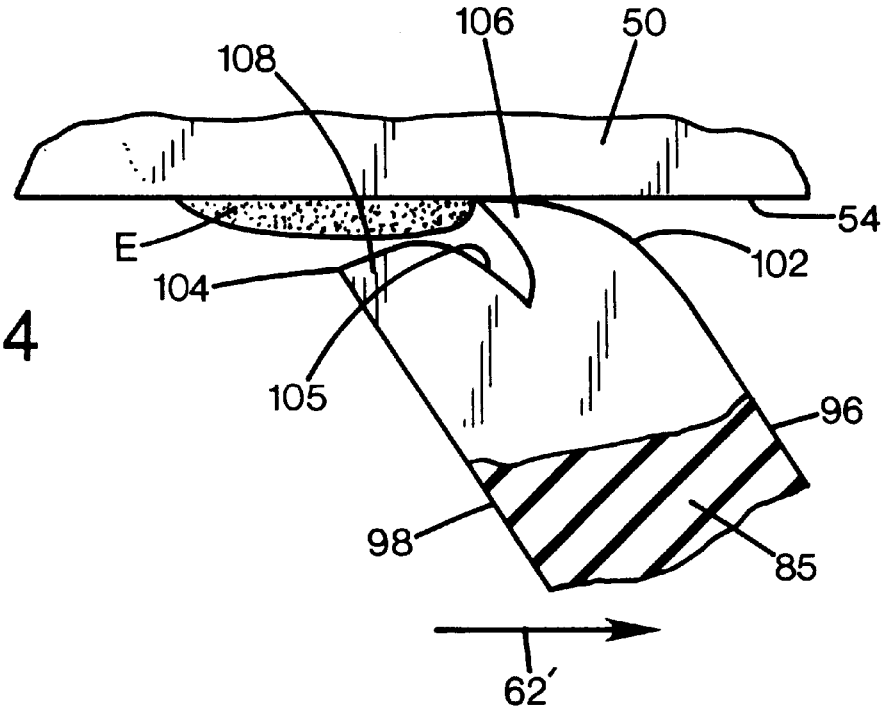
FIG. 4 is an enlarged, partially fragmented, side elevational view of the leading wiper blade of FIG. 1, shown disengaging an encapsulant bead during a wiping stroke.
Figure 5:
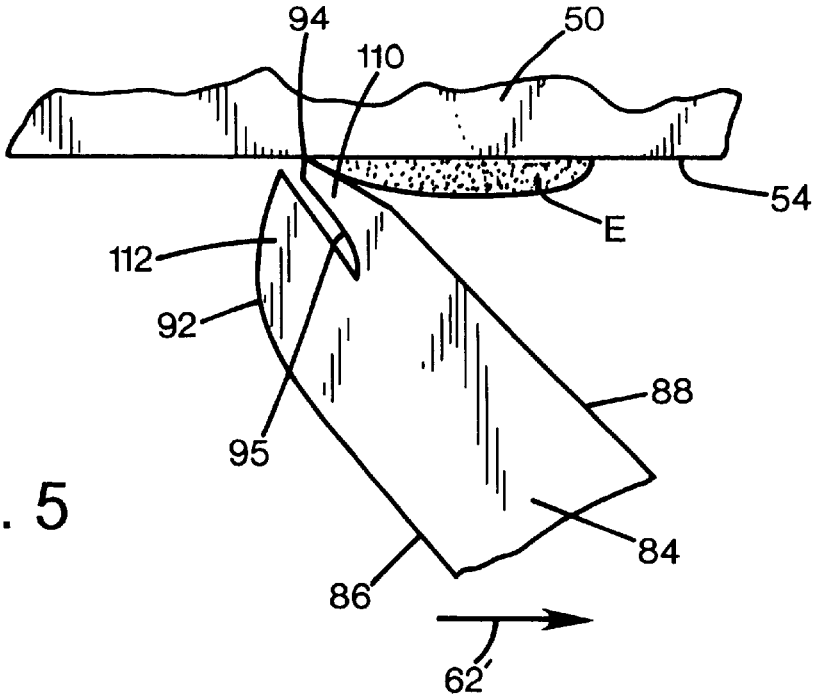
FIG. 5 is an enlarged, side elevational view of the trailing wiper blade of FIG. 1, shown encountering the encapsulant bead during a wiping stroke.
Figure 6:
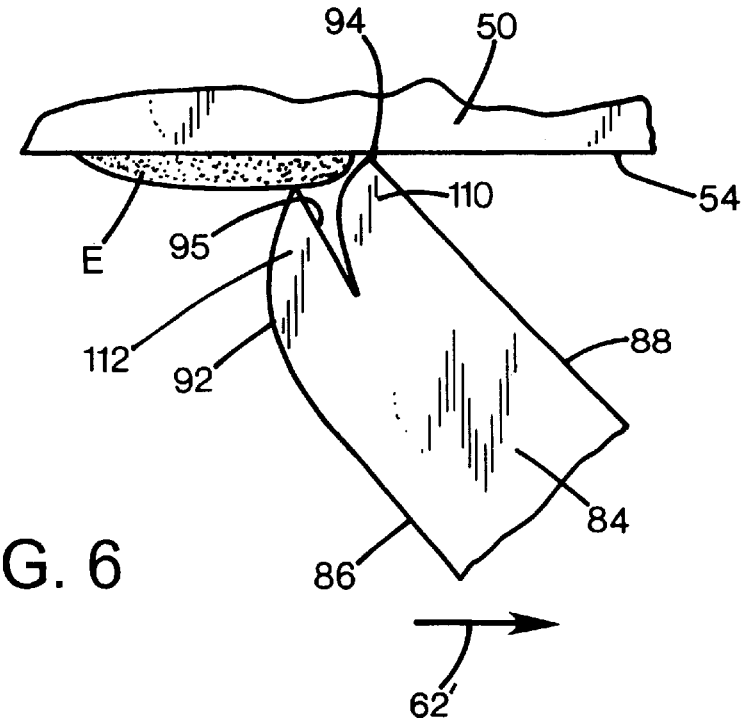
FIG. 6 is an enlarged, side elevational view of the trailing wiper blade of FIG. 1, shown disengaging the encapsulant bead during a wiping stroke.

The grooved wiper tips 90, 100 add more compliance to the wiper tip than the earlier solid wiper blades described in the Background Section above. Both of the grooves 95, 105 run at a transverse angle to the wiping direction, here, shown as a 90° angle so the grooves are longitudinal to the width of the wipers and run perpendicular to the wiping direction of arrow 62 in FIG. 2. By having the grooves 95, 105 at an angle with respect to the wiping direction 62, the mouths 95, 105 close partially or fully during a wiping stroke, changing the shape of the blade's interfacing contact with the orifice plate and encapsulant beads E. This greater compliance of the grooved wiping tips 90, 100 allows the shape of the wiper tip to conform to the uneven printhead terrain adjacent to the encapsulant beads E as shown in FIGS. 4–6. Indeed, while for the purposes of illustration only a single groove 95, 105 is shown in each wiper blade 84, 85, other grooves may be added running at least partially or along the entire width of the wiper blades 84, 85 although for ease of manufacturability, a single groove 95, 105 is presently preferred.

It is apparent that the grooves 95, 105 may be of different shapes or configurations for the black wiper assembly 80 and the color wiper assembly 82. While the presently preferred embodiment shows the grooves 95, 105 not intersecting either the outboard surfaces 86, 96 or the inboard surfaces 88, 98, it is apparent that in some implementations, the grooves may intersect at least one of the surfaces 86, 96, 88 or 98 to further tailor the blade compliance at specific locations across the printhead, such as along the nozzle arrays. Moreover, in some implementations, it may be preferable to terminate the groove before it intersects one or both of the side edges of the blade, or to only have grooves at the sides of the blade, leaving a portion of the wiper tip without a groove therein.

FIG. 4 shows the leading wiper blade 85 in the process of a wiping stroke toward the right, as indicated by arrow 62', as the blade 85 leaves the encapsulant bead E and touches down on the surface of the printed orifice plate. Here, we see the groove 105 surrounded by two lips, one lip 106 being adjacent to the rounded wiping edge 102, and another lip 108 being adjacent to the angular wiping edge 104. As the wiper 85 leaves the encapsulant bead E, the leading lip 106 slides off of the encapsulant bead E and achieves adequate wiping in the touchdown zone, described in the Background Section above with respect to FIG. 8. If additional compliance is needed, in some implementations the mouths 95, 105 may be made larger in size, or conversely, smaller in size if less compliance is desired.

As described in the Background Section above, the rounded wiping edge 102 forms a capillary passageway between the blade 85 and the printhead 54, which serves to wick ink through capillary forces from the printhead nozzles. The rounded wiping edge 102 then pulls this wicked ink from nozzle to nozzle along nozzle array to aid in dissolving any ink residue on the printhead surface. One limiting design factor on the size selected for the grooves 95, 105 may be wiper longevity in that too deep of a notch may cause one of the lips 106, 108 to break off after extended periods of use. Indeed, it is believed that the rounded wiping edge 102, and the rounded edge of lip 108 adjacent to groove 105, may both serve to wick ink from the printhead nozzles, giving improved wicking performance through the use of two wicking surfaces over that provided by the earlier wiper blade design described in U.S. Pat. No. 5,614,930, assigned to the Hewlett-Packard Company.

FIGS. 5 and 6 illustrated the wiping operation of the trailing wiper blade 84. FIG. 5 shows the trailing wiper blade 84 beginning to encounter the encapsulant bead E. The groove 95 of blade 84 is surrounded by two lips, with one lip 110 being adjacent to the angular wiping edge 94, and another lip 112 being adjacent to the rounded wiping edge 92. FIG. 5 shows the groove or mouth 95 may be closed either partially or completely by compression of the lip 110 as the wiper encounters the encapsulant bead E. This closing of mouth 95 serves to push the angular wiping edge 94 into the region of the orifice plate adjacent the encapsulant bead E as the trailing blade 84 moves in the direction of arrow 62'.

Figure 7:
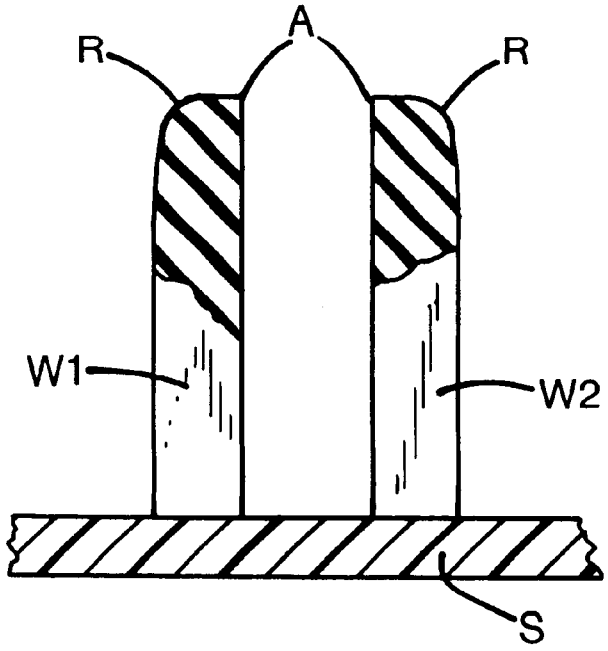
FIG. 7 PRIOR ART
FIG. 7 is an enlarged, partially fragmented, side elevational view of a prior art wiping system discussed in the Background Section above.
Figure 8:
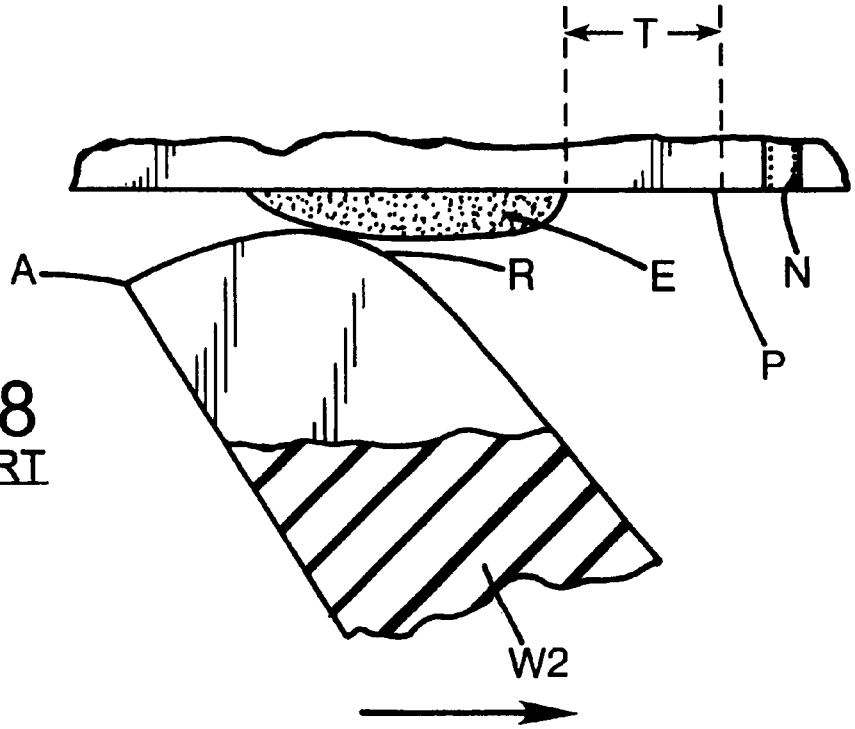
FIG. 8 PRIOR ART
FIG. 8 is an enlarged, partially fragmented, side elevational view of the prior art wiping system of FIG. 7, shown wiping over an encapsulant bead.

FIG. 6 shows the trailing wiper blade 84 leaving the encapsulant bead E during the wiping stroke. Here we see the angular wiping edge 94 contacting the orifice plate 54 in the touchdown region (shown as dimension T in FIG. 8) much closer to the encapsulant bead E than was possible with the earlier solid tipped wiper blade system shown in FIG. 8. The angular wiping edge 94 serves to remove dissolved ink residue and any wicked ink remaining on the orifice plate following the wiping stroke of the rounded portions of the leading blade 85. The angular nature of the trailing blade profile, both at wiping edge 94 and along the tip of lip 112 adjacent the mouth 95, serves not only to wipe the printhead clean, but these angular wiping edges do not promote wicking of any additional ink from the nozzles, leaving the orifice plate clean and dry. Thus, the touchdown zone, which was a concern when wiping with the earlier solid wiper tip designs shown in FIGS. 7 and 8, is now adequately covered and cleaned by both the leading wiper blade and the trailing wiper blades using the new grooved tip wiping system 60.

Following printhead wiping, the wiper assemblies 80, 82 are moved toward the front of the printer, in the positive Y-axis direction, where they encounter the wiper scraper bar 78, shown in FIG. 2. The scraper bar 78 extends downwardly into the path of travel of the wiper assemblies 80, 82, so by moving the sled 70 under the scraper bar 78, and then back into the printhead wiping zone, the scraper bar 78 removes ink residue from both the forward facing and rearward facing surfaces of each blade. Additionally, contact of the grooved wiper tips 90, 100 with the scraper blades forces the mouths 95, 105 to close and push out any ink residue remaining in the mouths 95, 105.

Advantages

Thus, there are a variety of advantages associated with using the grooved wiper tip printhead cleaning system 60. By using a dual symmetrical blade design for wiper assemblies 80 and 82, bi-directional wiping may be accomplished by moving the pallet 70 back and forth in the direction of arrow 62 under the printheads 54, 56. Moreover, use of the grooved wiper tip 95, 105 creates a more compliant two-step wiper tip. In this two-step wiping system, the leading lip, such as lip 106 in FIG. 4 or lip 110 in FIGS. 5 and 6, contacts the orifice plate 54 upon leaving the encapsulant bead E, followed by the second lip 108, 112 then contacting this touchdown region of the orifice plate 54. Thus, this two-stage wiping design that traverses over surface irregularities on the printheads 54, 56 such as the encapsulant beads E, by quickly transitioning from wiping the irregularity to wiping the nozzle surface of the printhead 54, 56 adjacent the beads E. Furthermore, use of this two-step wiping system also promotes ink wicking by leading blade, such as shown for blade 85 in FIG. 4, to promote more effective printhead cleaning.

While the grooved wiper tip printhead cleaning system 60 has been illustrated as being supported by a sled which moves between a rest position and a printhead wiping position, as well as a wiper scraping position, it is apparent that wiping through relative motion of the printheads 54, 56 and the wipers 80, 82 may be accomplished in a variety of different manners known to those skilled in the art. For example, a grooved wiper blade may be held by the sled in a stationary position, rotated 90° from the orientation pictured in the drawings, and located in the path traversed by the printhead when entering and exiting the service station region 45. In such a system, wiping is accomplished by moving the printhead back and forth across the wiper, particularly when only a single printhead is used or when the inks of multiple printheads are compatible for wiping with a single wiper. Other ramped, rotary and translational sleds are known for selectively elevating the wipers between rest and wiping positions for cleaning one or more printheads through printhead motion. Other sled systems are known for moving the wipers while holding the printheads stationary to accomplish wiping, such as the rotary orthogonal wiping system discussed in the Background Section above. Indeed, the grooved wiper tip printhead cleaning system 60 may be used in a page-wide array inkjet printing mechanism having a printhead which partially or completely spans across the entire printzone 25, eliminating the need for a reciprocating carriage 40 to carry the printhead back and forth across the printzone. In such a page-wide array printer, the grooved tip wiper blade or blades may be moved by a sled across the printhead array, or the page-wide printhead array may be swept across the wiper blade or blades to achieve the relative wiping motion. It is apparent that in a page-wide array printer the printhead servicing region may be considered to be located along the printzone 25, rather than to the side of the printzone, as illustrated for the reciprocating printer 20.

The opening and closing action of the mouths 95, 105 advantageously serves to squeeze out any ink residue which may become trapped in the mouth during wiping.

Furthermore, use of the groove 95, 105 has little impact on the overall normal force (the force in a direction perpendicular to the orifice plate) provided by the compliance and flexing of the blades 84, 85. Thus, if the mouths 95, 105 close during wiping, the performance of the blades 84, 85 is comparable with that of the earlier non-grooved wiper designs discussed in the Background Section with respect to FIGS. 7 and 8. With the mouths 95, 105 closed, the blades 84, 85 perform in the same manner as a solid, non-grooved wiper tip, while giving better wiping performance at the surface irregularities.

We claim:

1. A wiping system for cleaning a printhead of an inkjet printing mechanism having a chassis, comprising:

a sled supported by the chassis; and a wiper blade having:

a base supported by the sled;

a wiping tip opposite the base; and a solid body separating the base and tip wherein:

the body has opposing leading and trailing surfaces;

the tip defines a groove running between the leading surface and the trailing surface, delineating a leading tip section and a trailing tip section; and the tip wipes the printhead through relative motion of the blade and the printhead such that the leading tip section and the trailing tip section simultaneously contact the printhead for at least a portion of a unidirectional wiping stroke.

2. A wiping system according to claim 1 wherein the groove defined by the wiping tip runs between the leading surface and the trailing surface without intersecting either the leading surface or the trailing surface.

3. A wiping system according to claim 1 wherein the wiping tip has an arcuate profile adjacent the leading surface and an angular profile adjacent the trailing surface.

4. A wiping system according to claim 3 wherein the arcuate profile of the wiping tip comprises a rounded profile, and the angular profile of the wiping tip comprises a square profile.

5. A wiping system according to claim 1 wherein:

the wiping tip has a first arcuate profile adjacent the leading surface;

the wiping tip has a second arcuate profile adjacent the groove facing toward the leading surface;

the wiping tip has a first angular profile adjacent the trailing surface; and the wiping tip has a second angular profile adjacent the groove facing toward the trailing surface.

6. A wiping system according to claim 5 wherein:

the first arcuate profile of the wiping tip comprises a rounded profile;

the second arcuate profile of the wiping tip comprises a rounded profile; and the first angular profile comprises a square profile.

7. A wiping system according to claim 1:

wherein said wiper blade comprises a first wiper blade; and the wiping system further includes a second wiper blade supported by the sled to engage and wipe the printhead through relative motion of the blade and the printhead during the unidirectional wiping stroke, with the wiper blade having a leading surface, which encounters the printhead when wiping during the unidirectional wiping stroke, and a trailing surface opposing the leading surface, with the leading surface and the trailing surface joining at a wiping tip which defines a groove therein running between the leading surface and the trailing surface, and with the leading surface of the second wiper blade facing the trailing surface of the first wiper blade.

8. A wiping system according to claim 7 wherein:

the groove defined by the wiping tip of the first wiper blade runs between the leading surface and the trailing surface thereof without intersecting either the leading surface or the trailing surface of the first wiper blade; and the groove defined by the wiping tip of the second wiper blade runs between the leading surface and the trailing surface thereof without intersecting either the leading surface or the trailing surface of the second wiper blade.

9. A wiping system according to claim 7 wherein:

for the first wiper blade:

the wiping tip has a first arcuate profile adjacent the leading surface;

the wiping tip has a second arcuate profile adjacent the groove facing toward the leading surface;

the wiping tip has a first angular profile adjacent the trailing surface;

the wiping tip has a second angular profile adjacent the groove facing toward the trailing surface; and for the second wiper blade:

the wiping tip has a first angular profile adjacent the leading surface;

the wiping tip has a second angular profile adjacent the groove facing toward the leading surface;

the wiping tip has a first arcuate profile adjacent the trailing surface;

the wiping tip has a second arcuate profile adjacent the groove facing toward the trailing surface.

10. A wiping system according to claim 1 wherein the groove defined by the wiping tip runs between the leading surface and the trailing surface without intersecting the leading surface.

11. A wiping system according to claim 1 wherein the groove defined by the wiping tip runs between the leading surface and the trailing surface without intersecting the trailing surface.

12. A printing mechanism, comprising:

a chassis;

an inkjet printhead supported by the chassis to print in a printzone;

a sled supported by the chassis in a servicing region; and a wiper blade having:

a base supported by the sled;

a wiping tip opposite the base;

a solid body separating the base and tip wherein:

the body has opposing leading and trailing surfaces;

the tip defines a groove running between the leading and trailing surfaces, delineating a leading tip section and a trailing tip section; and the tip wipes the printhead through relative motion of the blade and the printhead such that the leading tip section and the trailing tip section simultaneously contact the printhead for at least a portion of a unidirectional wiping stroke.

13. A printing mechanism according to claim 12 wherein the wiper blade groove defined by the wiping tip runs between the leading surface and the trailing surface without intersecting either the leading surface or the trailing surface.

14. A printing mechanism according to claim 12 wherein the wiping tip has an arcuate profile adjacent the leading surface and an angular profile adjacent the trailing surface.

15. A printing mechanism according to claim 12 wherein:

the wiping tip has a first arcuate profile adjacent the leading surface;

the wiping tip has a second arcuate profile adjacent the groove facing toward the leading surface;

the wiping tip has a first angular profile adjacent the trailing surface; and the wiping tip has a second angular profile adjacent the groove facing toward the trailing surface.

16. A printing mechanism according to claim 12 wherein:

said wiper blade comprises a first wiper blade; and the wiping system further includes a second wiper blade supported by the sled to engage and wipe the printhead through relative motion of the blade and the printhead during the unidirectional wiping stroke, with the wiper blade having a leading surface, which encounters the printhead when wiping during the unidirectional wiping stroke, and a trailing surface opposing the leading surface, with the leading surface and the trailing surface joining at a wiping tip which defines a groove therein running between the leading surface and the trailing surface, and with the leading surface of the second wiper blade facing the trailing surface of the first wiper blade.

17. A printing mechanism according to claim 16 wherein:

for the first wiper blade:

the wiping tip has a first arcuate profile adjacent the leading surface;

the wiping tip has a second arcuate profile adjacent the groove facing toward the leading surface;

the wiping tip has a first angular profile adjacent the trailing surface;

the wiping tip has a second angular profile adjacent the groove facing toward the trailing surface; and for the second wiper blade:

the wiping tip has a first angular profile adjacent the leading surface;

the wiping tip has a second angular profile adjacent the groove facing toward the leading surface;

the wiping tip has a first arcuate profile adjacent the trailing surface;

the wiping tip has a second arcuate profile adjacent the groove facing toward the trailing surface.

18. A printing mechanism according to claim 12 further including a carriage supported by the chassis to carry the inkjet printhead reciprocally across the printzone.

19. A printing mechanism according to claim 18 wherein the sled is moveably supported by the chassis to provide the relative motion to move the wiper across the printhead in the unidirectional wiping stroke while the carriage holds the printhead in a stationary position.

20. A method of cleaning an inkjet printhead of a printing mechanism, comprising:

providing a wiper blade having a base and a wiping tip separated by a solid body which has opposing first and second surfaces, with the wiping tip defining a groove therein running between the first and second surfaces without intersecting at least one of the first and second surfaces, wherein the groove delineates leading and trailing tip sections;

wiping the printhead with a unidirectional wiping stroke through relative motion of the wiper blade and the printhead; and during the wiping step:

simultaneously contacting the printhead with the leading tip section and the trailing tip section for at least a portion of the unidirectional wiping stroke; and at least partially closing the groove.

21. A method according to claim 20, wherein the wiping step comprises moving the wiper across the printhead.

22. A method according to claim 20, wherein:

the providing step comprises providing the wiper blade wherein the wiping tip has an arcuate profile adjacent the first surface and an angular profile adjacent the second surface; and the wiping step comprises the steps of contacting the printhead with the arcuate profile of the wiping tip when wiping in a first direction, and contacting the printhead with the angular profile of the wiping tip when wiping in a second direction opposite the first direction.

23. A method according to claim 22 for cleaning an inkjet printhead which has a face plate defining at least two adjacent ink ejecting nozzles extending therethrough, wherein the method further includes the steps of:

extracting ink from one nozzle through capillary action while wiping in the first direction; and moving the extracted ink along the face plate with the wiper.

24. A method according to claim 23, wherein:

the providing step comprises providing said wiper blade as a first wiper blade, and further providing a second wiper blade having a first surface and a second surface opposing the first surface, with the first surface and the second surface joining at a wiping tip which defines a groove therein running between the first surface and the second surface without intersecting at least one of the first and second surfaces;

the extracting step comprises the step of extracting ink from said one nozzle with one of the blades; and the moving step comprises the step of removing the extracted ink from the face plate with the second blade to contact said one nozzle.

25. A method according to claim 20 for cleaning an inkjet printhead which has a face plate defining at least two adjacent ink ejecting nozzles extending therethrough, wherein:

the providing step comprises providing the wiper blade wherein the wiping tip has a first arcuate profile adjacent the first surface, a second arcuate profile adjacent the groove facing toward the first surface, a first angular profile adjacent the second surface, and a second angular profile adjacent the groove facing toward the second surface;

the wiping step comprises the steps of contacting the printhead with the first and second arcuate profile of the wiping tip when wiping in a first direction, and contacting the printhead with the first and second angular profile of the wiping tip when wiping in a second direction opposite the first direction; and the method further includes the steps of extracting ink from one nozzle through capillary action while wiping in the first direction, and moving the extracted ink along the face plate with the wiper.

26. A method according to claim 20, wherein the method further includes the step of squeezing ink residue from the groove during the step of at least partially closing the groove.

27. A method according to claim 20, wherein the method further includes the step of conforming the wiper tip over a surface irregularity on the printhead during the step of at least partially closing the groove.

28. A method according to claim 20, wherein the method further includes the step of at least partially opening the groove during the wiping step when wiping over a surface irregularity on the printhead.

29. A wiping system for cleaning an inkjet printhead of a printing mechanism having a chassis, comprising:

a sled supported by the chassis; and a wiper blade having:

a base supported by the sled;

a wiping tip opposite the base; and a solid body separating the base and tip, wherein:

the tip wipes the printhead through relative motion of the blade and the printhead in a unidirectional wiping stroke; and the tip defines a transverse groove therein running transverse to the wiping direction, the groove delineating a first tip section and a second tip section, wherein the first and second tip sections simultaneously contact the printhead for at least a portion of the unidirectional wiping stroke.

30. A wiping system according to claim 29 wherein the wiper blade has a leading surface, which encounters the printhead when wiping in the wiping direction, and a trailing surface opposing the leading surface, with the groove defined by the wiping tip running between the leading surface and the trailing surface without intersecting either the leading surface or the trailing surface.

31. A wiping system according to claim 29 wherein the groove is substantially perpendicular to the wiping direction.

32. A wiping system according to claim 29 wherein the wiper blade has a leading surface, which encounters the printhead when wiping in the wiping direction, and a trailing surface opposing the leading surface, with the wiping tip having an arcuate profile adjacent the leading surface and an angular profile adjacent the trailing surface.

33. A wiping system according to claim 32 wherein:

the wiping tip has a first arcuate profile adjacent the leading surface;

the wiping tip has a second arcuate profile adjacent the groove facing toward the leading surface;

the wiping tip has a first angular profile adjacent the trailing surface; and the wiping tip has a second angular profile adjacent the groove facing toward the trailing surface.

34. A wiping system according to claim 29:

wherein said wiper blade comprises a first wiper blade having a leading surface, which encounters the printhead when wiping in the wiping direction, and a trailing surface opposing the leading surface; and the wiping system further includes a second wiper blade supported by the sled to engage and wipe the printhead through relative motion of the blade and the printhead during the unidirectional wiping stroke, with the second wiper blade having a leading surface, which encounters the printhead when wiping during the unidirectional wiping stroke, a trailing surface opposing the leading surface, and a wiping tip which defines a transverse groove running transverse to the wiping direction, with the leading surface of the second wiper blade facing the trailing surface of the first wiper blade.

35. A printing mechanism, comprising:

a chassis;

an inkjet printhead supported by the chassis to print in a printzone; and a wiping system for cleaning the printhead, comprising:

a sled supported by the chassis in a servicing region; and a wiper blade having:

a base supported by the sled;

a wiping tip opposite the base; and a solid body separating the base and tip, wherein the tip:

wipes the printhead through relative motion of the blade and the printhead in a unidirectional wiping stroke; and defines a groove therein running transverse to the wiping direction, the groove delineating first and second tip sections, which simultaneously contact the printhead for at least a portion of the unidirectional wiping stroke.

36. A wiping system for cleaning an inkjet printhead of an inkjet printing mechanism having a chassis, with the printhead having a surface irregularity, comprising:

a sled supported by the chassis; and a wiper blade having two opposing wiping surfaces terminating in a wiping tip which wipes the printhead through relative motion of the blade and the printhead in a wiping direction, with the wiper blade being supported by the sled, and with the tip defining a groove therein running between said two opposing wiping surfaces, with the groove opening and closing when traversing over the printhead surface irregularity while wiping the printhead.

37. A wiping system according to claim 36 wherein the groove defined by the wiping tip runs between the leading surface and the trailing surface without intersecting either the leading surface or the trailing surface.

38. A wiping system according to claim 36 wherein the wiping tip has an arcuate profile adjacent the leading surface and an angular profile adjacent the trailing surface.

39. An inkjet printing mechanism, comprising:

a chassis which defines a printzone and a servicing region;

an inkjet printhead supported by the chassis to print an image in the printzone;

a sled supported by the chassis in the servicing region;

a wiping system for cleaning the inkjet printhead, comprising:

a sled supported by the chassis; and a wiper blade having two opposing wiping surfaces terminating in a wiping tip which wipes the printhead through relative motion of the blade and the printhead in a wiping direction, and with the tip defining a groove therein running between said two opposing wiping surfaces, with the groove opening and closing when traversing over the printhead surface irregularity while wiping the printhead.

40. A wiping system according to claim 39 wherein the groove defined by the wiping tip runs between the leading surface and the trailing surface without intersecting either the leading surface or the trailing surface.

* * * * *